US010204584B2

(12) United States Patent
Shi et al.

(10) Patent No.: US 10,204,584 B2
(45) Date of Patent: Feb. 12, 2019

(54) GOA CIRCUIT AND LIQUID CRYSTAL DISPLAY

(71) Applicant: Shenzhen China Star Optoelectronics Technology Co., Ltd., Shenzhen, Guangdong (CN)

(72) Inventors: Longqiang Shi, Guangdong (CN); Shu-Jhih Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 146 days.

(21) Appl. No.: 15/326,937

(22) PCT Filed: Jan. 16, 2017

(86) PCT No.: PCT/CN2017/071233
§ 371 (c)(1),
(2) Date: Jan. 17, 2017

(87) PCT Pub. No.: WO2018/120316
PCT Pub. Date: Jul. 5, 2018

(65) Prior Publication Data

US 2018/0211623 A1 Jul. 26, 2018

(30) Foreign Application Priority Data

Dec. 30, 2016 (CN) ..... 2016 1 1256841

(51) Int. Cl.
*G09G 3/36* (2006.01)

(52) U.S. Cl.
CPC ... *G09G 3/3677* (2013.01); *G09G 2300/0408* (2013.01); *G09G 2310/0286* (2013.01)

(58) Field of Classification Search
CPC ..... G09G 3/3677; G09G 2310/0286
See application file for complete search history.

(56) References Cited

U.S. PATENT DOCUMENTS 6,426,743 B1 * 7/2002 Yeo ..... G09G 3/3677 345/100
2008/0048712 A1 * 2/2008 Ahn ..... G09G 3/3677 326/21

(Continued)

FOREIGN PATENT DOCUMENTS

CN 106057119 A 10/2016
CN 106128409 A 11/2016

(Continued)

OTHER PUBLICATIONS

U.S. Appl. No. 11/846,383, filed Mar. 6, 2008, Yu-ju Kuo et al.

*Primary Examiner* — Kevin M Nguyen
(74) *Attorney, Agent, or Firm* — Andrew C. Cheng

(57) ABSTRACT

The present disclosure provides a GOA circuit and a liquid crystal display, the GOA circuit includes: a pull-up circuit; a scan output terminal; a pull-up control circuit including: a second switch tube; a third switch tube having a first connection terminal coupled to the second connection terminal of the second switch tube and a second connection terminal coupled to the control terminal of the first switch tube; a fourth switch tube having a control terminal coupled to the control terminal of the first switch tube, a first connection terminal coupled to the first connection terminal of the third switch tube and a second connection terminal coupled to the scan output terminal. In this way, the disclosure can avoid the problem that the transistor is erroneously turned on or off due to the threshold drift and the circuit output error is caused.

14 Claims, 5 Drawing Sheets

(56) References Cited

U.S. PATENT DOCUMENTS

| | | | | |
|---|---|---|---|---|
| 2009/0304138 | A1* | 12/2009 | Tsai | G11C 19/28 377/79 |
| 2011/0157263 | A1* | 6/2011 | Kim | G09G 3/3677 345/698 |
| 2016/0140922 | A1 | 5/2016 | Dai et al. | |
| 2016/0267864 | A1 | 9/2016 | Xiao | |
| 2016/0307535 | A1 | 10/2016 | Xiao | |
| 2016/0335962 | A1 | 11/2016 | Xiao | |

FOREIGN PATENT DOCUMENTS

| | | | |
|---|---|---|---|
| CN | 106297719 | A | 1/2017 |
| CN | 106448592 | A | 2/2017 |

* cited by examiner

GOA CIRCUIT AND LIQUID CRYSTAL DISPLAY

FIELD OF THE DISCLOSURE

The present disclosure relates to a liquid crystal display technology field, and more particularly to a GOA circuit and a liquid crystal display.

BACKGROUND OF THE DISCLOSURE

GOA (Gate Driver on Array) technology can help to create narrow or borderless display products, and reduce the external integrated circuit (IC) binding process is conducive to enhance productivity and reduce product costs, which has been widely used and research.

IGZO (indium gallium zinc oxide), because of its high mobility and good device stability, in the production of GOA circuit, can reduce the complexity of GOA circuit, has been widely used. In particular, because of its high mobility, when used in the fabrication of thin film transistors in GOA circuits, the size of a thin film transistor is small relative to a thin film transistor fabricated using a-Si (amorphous silicon), thereby facilitating narrow frame display; at the same time, due to good device stability, can be used to stabilize the performance of thin-film transistor power and thin-film transistor number, and then to create a relatively simple GOA circuit, and reduce power consumption.

However, the opening voltage Vth of the thin-film transistor manufactured by the IGZO is liable to be a negative value, resulting in the failure of the GOA circuit

SUMMARY OF THE DISCLOSURE

The present disclosure has been made to solve the above-mentioned problems and to provide a GOA circuit and a liquid crystal display device capable of preventing the transistor from erroneously turning on or off due to threshold drift and causing a problem of circuit output error.

In order to solve the above technical problem, the disclosure adopts the technical scheme is: provides a GOA circuit, the GOA circuit includes: a pull-up circuit including a first switch tube; a scan output terminal coupled to the second connection terminal of the first switch tube; a pull-up control circuit including: a second switch tube; a third switch tube having a first connection terminal coupled to the second connection terminal of the second switch tube and a second connection terminal coupled to the control terminal of the first switch tube; a fourth switch tube having a control terminal coupled to the control terminal of the first switch tube, a first connection terminal coupled to the first connection terminal of the third switch tube and a second connection terminal coupled to the scan output terminal for controlling the control terminal level of the second switch tube to be lower than the first connection terminal level of the second switch tube when the first level is outputted at the scan output terminal.

Wherein, the GOA circuit further includes: a intermediate circuit including a fifth switch tube whose control terminal is coupled to the second connection terminal of the third switch tube and whose second connection terminal is coupled to the level-transmission output terminal.

Wherein, the GOA circuit further includes a pull-down circuit and a clamp circuit; the first pull-down circuit includes: a sixth switch tube having a first connection terminal coupled to the scan output terminal; a seventh switch tube having a first connection terminal coupled to the level-transmission output terminal; a eighth switch tube having a first connection terminal coupled to the second connection terminal of the third switch tube; the clamp circuit is coupled to the control terminal and second connection terminal of the sixth switch tube, the seventh switch tube and the eighth switch tube for controlling the control terminal level of the sixth switch tube, the seventh switch tube and the eighth switch tube to be lower than the second connection terminal level of the sixth switch tube, the seventh switch tube and the eighth switch tube, when the first level is outputted at the scan output terminal and for controlling the control terminal level of the sixth switch tube, the seventh switch tube and the eighth switch tube to be higher than the second connection terminal level of the sixth switch tube, the seventh switch tube and the eighth switch tube, when the second level is outputted at the scan output terminal, the first level being higher than the second level.

wherein, the GOA circuit further includes a second pull-down circuit; the second pull-down circuit includes: a ninth switch tube having the first connection terminal coupled to the second connection terminal of the third switch tube; a tenth switch tube having the first connection terminal coupled to the level-transmission output terminal; a eleventh switch tube having the first connection terminal coupled to the scan output terminal; the clamp circuit coupled to the control terminal and second connection terminal of the ninth switch tube, the tenth switch tube, the eleventh switch tube for controlling the control terminal level of the ninth switch tube, the tenth switch tube, the eleventh switch tube to be lower than the second connection terminal level of the ninth switch tube, the tenth switch tube, the eleventh switch tube, when the scan output terminal outputted the first level, and for controlling the control terminal level of the ninth switch tube, the tenth switch tube, the eleventh switch tube to be higher than the second connection terminal level of the ninth switch tube, the tenth switch tube, the eleventh switch tube, when the scan output terminal outputted the second level.

Wherein, the clamp circuit controls the first pull-down circuit and the second pull-down circuit to operate alternately.

Wherein, the clamp circuit includes a first control circuit, a first clamp terminal and a second clamp terminal; the first clamp terminal is configured to receive a third level and is coupled to the second connection terminal of the sixth switch tube, the seventh switch tube and the eighth switch tube, the second clamp terminal is configured to receive a fourth level, the third level is higher than the fourth level; the first control circuit includes: a twelfth switch tube having a control terminal and a first connection terminal configured to receive a first control signal; a thirteen switch tube having a control terminal coupled to the second connection terminal of the twelfth switch tube, a first connection terminal configured to receive the first control signal, a second connection terminal coupled to the control terminal of the sixth switch tube, the seventh switch tube and the eighth switch tube; a fourteenth switch tube having a control terminal coupled to the second connection terminal of the third switch tube, a first connection terminal coupled to the second connection terminal of the twelfth switch tube, a second connection terminal coupled to the second clamp terminal; a fifteenth switch tube having a control terminal coupled to the second connection terminal of the third switch tube, a first connection terminal coupled to the second connection terminal of the thirteenth switch tube, a second connection terminal coupled to the second clamp terminal.

Wherein, the clamp circuit further includes a second control circuit; the second control circuit includes: a sixteenth switch tube having a control terminal and a first connection terminal configured to receive a second control signal; a seventeenth switch tube having a control terminal coupled to the second connection terminal of the sixteenth switch tube, a first connection terminal configured to receive the second control signal, a second connection terminal coupled to the control terminal of the ninth switch tube, the tenth switch tube and the eleventh switch tube; a eighteenth switch tube having a control terminal coupled to the second connection terminal of the third switch tube, a first connection terminal coupled to the second connection terminal of the sixteenth switch tube, a second connection terminal coupled to the second clamp terminal; a nineteenth switch tube having a control terminal coupled to the second connection terminal of the third switch tube, a first connection terminal coupled to the second connection terminal of the seventeenth switch tube, a second connection terminal coupled to the second clamp terminal.

Wherein, the pull-up circuit further includes a capacitor coupled between the scan output terminal and the control terminal of the first switch tube.

Wherein, the first connection terminal of the first switch tube is configured to receive a first clock signal, the control terminal of the second switch tube and the third switch tube is configured to receive a second clock signal, the first connection terminal of the second switch tube is configured to receive a level-transmission signal; and the first clock signal is opposite to the second clock signal.

In order to solve the above-mentioned technical problems, another technical scheme adopted by the present disclosure is: provides a liquid crystal display, the liquid crystal display includes a GOA circuit, the GOA circuit includes: a pull-up circuit including a first switch tube; a scan output terminal coupled to the second connection terminal of the first switch tube; the pull-up circuit further includes a capacitor coupled between the scan output terminal and the control terminal of the first switch tube; a pull-up control circuit including: a second switch tube; a third switch tube having a first connection terminal coupled to the second connection terminal of the second switch tube and a second connection terminal coupled to the control terminal of the first switch tube; a fourth switch tube having a control terminal coupled to the control terminal of the first switch tube, a first connection terminal coupled to the first connection terminal of the third switch tube and a second connection terminal coupled to the scan output terminal for controlling the control terminal level of the second switch tube to be lower than the first connection terminal level of the second switch tube when the first level is outputted at the scan output terminal; wherein, the first connection terminal of the first switch tube is configured to receive a first clock signal, the control terminal of the second switch tube and the third switch tube is configured to receive a second clock signal, the first connection terminal of the second switch tube is configured to receive a level-transmission signal, and the first clock signal is opposite to the second clock signal.

wherein, the GOA circuit further includes: a intermediate circuit including a fifth switch tube whose control terminal is coupled to the second connection terminal of the third switch tube and whose second connection terminal is coupled to the level-transmission output terminal.

Wherein, the GOA circuit further includes a pull-down circuit and a clamp circuit; the first pull-down circuit includes: a sixth switch tube having a first connection terminal coupled to the scan output terminal; a seventh switch tube having a first connection terminal coupled to the level-transmission output terminal; a eighth switch tube having a first connection terminal coupled to the second connection terminal of the third switch tube; the clamp circuit is coupled to the control terminal and second connection terminal of the sixth switch tube, the seventh switch tube and the eighth switch tube for controlling the control terminal level of the sixth switch tube, the seventh switch tube and the eighth switch tube to be lower than the second connection terminal level of the sixth switch tube, the seventh switch tube and the eighth switch tube, when the first level is outputted at the scan output terminal and for controlling the control terminal level of the sixth switch tube, the seventh switch tube and the eighth switch tube to be higher than the second connection terminal level of the sixth switch tube, the seventh switch tube and the eighth switch tube, when the second level is outputted at the scan output terminal, the first level being higher than the second level.

wherein, the GOA circuit further includes a second pull-down circuit; the second pull-down circuit includes: a ninth switch tube having the first connection terminal coupled to the second connection terminal of the third switch tube; a tenth switch tube having the first connection terminal coupled to the level-transmission output terminal; a eleventh switch tube having the first connection terminal coupled to the scan output terminal; the clamp circuit coupled to the control terminal and second connection terminal of the ninth switch tube, the tenth switch tube, the eleventh switch tube for controlling the control terminal level of the ninth switch tube, the tenth switch tube, the eleventh switch tube to be lower than the second connection terminal level of the ninth switch tube, the tenth switch tube, the eleventh switch tube, when the scan output terminal outputted the first level, and for controlling the control terminal level of the ninth switch tube, the tenth switch tube, the eleventh switch tube to be higher than the second connection terminal level of the ninth switch tube, the tenth switch tube, the eleventh switch tube, when the scan output terminal outputted the second level.

Wherein, the clamp circuit controls the first pull-down circuit and the second pull-down circuit to operate alternately.

Wherein, the clamp circuit includes a first control circuit, a first clamp terminal and a second clamp terminal; the first clamp terminal is configured to receive a third level and is coupled to the second connection terminal of the sixth switch tube, the seventh switch tube and the eighth switch tube, the second clamp terminal is connected with a fourth level, the third level is higher than the fourth level; the first control circuit includes: a twelfth switch tube having a control terminal and a first connection terminal configured to receive a first control signal; a thirteen switch tube having a control terminal coupled to the second connection terminal of the twelfth switch tube, a first connection terminal configured to receive the first control signal, a second connection terminal coupled to the control terminal of the sixth switch tube, the seventh switch tube and the eighth switch tube; a fourteenth switch tube having a control terminal coupled to the second connection terminal of the third switch tube, a first connection terminal coupled to the second connection terminal of the twelfth switch tube, a second connection terminal coupled to the second clamp terminal; a fifteenth switch tube having a control terminal coupled to the second connection terminal of the third switch tube, a first connection terminal coupled to the second connection terminal of the thirteenth switch tube, a second connection terminal coupled to the second clamp terminal.

Wherein, the clamp circuit further includes a second control circuit; the second control circuit includes: a sixteenth switch tube having a control terminal and a first connection terminal configured to receive a second control signal; a seventeenth switch tube having a control terminal coupled to the second connection terminal of the sixteenth switch tube, a first connection terminal configured to receive the second control signal, a second connection terminal coupled to the control terminal of the ninth switch tube, the tenth switch tube and the eleventh switch tube; a eighteenth switch tube having a control terminal coupled to the second connection terminal of the third switch tube, a first connection terminal coupled to the second connection terminal of the sixteenth switch tube, a second connection terminal coupled to the second clamp terminal; a nineteenth switch tube having a control terminal coupled to the second connection terminal of the third switch tube, a first connection terminal coupled to the second connection terminal of the seventeenth switch tube, a second connection terminal coupled to the second clamp terminal.

In order to solve the above-mentioned technical problems, the other technical scheme adopted by the present disclosure is: provides a liquid crystal display, the liquid crystal display includes a GOA circuit, the GOA circuit includes: a pull-up circuit including a first switch tube; a scan output terminal coupled to the second connection terminal of the first switch tube; a pull-up control circuit including: a second switch tube; a third switch tube having a first connection terminal coupled to the second connection terminal of the second switch tube and a second connection terminal coupled to the control terminal of the first switch tube; a fourth switch tube having a control terminal coupled to the control terminal of the first switch tube, a first connection terminal coupled to the first connection terminal of the third switch tube and a second connection terminal coupled to the scan output terminal for controlling the control terminal level of the second switch tube to be lower than the first connection terminal level of the second switch tube when the first level is outputted at the scan output terminal.

Wherein, the GOA circuit further includes: a intermediate circuit including a fifth switch tube whose control terminal is coupled to the second connection terminal of the third switch tube and whose second connection terminal is coupled to the level-transmission output terminal.

Wherein, the GOA circuit further includes a pull-down circuit and a clamping circuit; the first pull-down circuit includes: a sixth switch tube having a first connection terminal coupled to the scan output terminal; a seventh switch tube having a first connection terminal coupled to the level-transmission output terminal; a eighth switch tube having a first connection terminal coupled to the second connection terminal of the third switch tube; the clamping circuit is coupled to the control terminal and second connection terminal of the sixth switch tube, the seventh switch tube and the eighth switch tube for controlling the control terminal level of the sixth switch tube, the seventh switch tube and the eighth switch tube to be lower than the second connection terminal level of the sixth switch tube, the seventh switch tube and the eighth switch tube, when the first level is outputted at the scan output terminal and for controlling the control terminal level of the sixth switch tube, the seventh switch tube and the eighth switch tube to be higher than the second connection terminal level of the sixth switch tube, the seventh switch tube and the eighth switch tube, when the second level is outputted at the scan output terminal, the first level being higher than the second level.

wherein, the GOA circuit further includes a second pull-down circuit; the second pull-down circuit includes: a ninth switch tube having the first connection terminal coupled to the second connection terminal of the third switch tube; a tenth switch tube having the first connection terminal coupled to the level-transmission output terminal; a eleventh switch tube having the first connection terminal coupled to the scan output terminal; the clamping circuit coupled to the control terminal and second connection terminal of the ninth switch tube, the tenth switch tube, the eleventh switch tube for controlling the control terminal level of the ninth switch tube, the tenth switch tube, the eleventh switch tube to be lower than the second connection terminal level of the ninth switch tube, the tenth switch tube, the eleventh switch tube, when the scan output terminal outputted the first level, and for controlling the control terminal level of the ninth switch tube, the tenth switch tube, the eleventh switch tube to be higher than the second connection terminal level of the ninth switch tube, the tenth switch tube, the eleventh switch tube, when the scan output terminal outputted the second level.

The present disclosure has the advantages is: different from the state of the prior art, the GOA circuit of the present disclosure includes: a pull-up circuit including a first switch tube; a scan output terminal coupled to the second connection terminal of the first switch tube; a pull-up control circuit including: a second switch tube; a third switch tube having a first connection terminal coupled to the second connection terminal of the second switch tube and a second connection terminal coupled to the control terminal of the first switch tube; a fourth switch tube having a control terminal coupled to the control terminal of the first switch tube, a first connection terminal coupled to the first connection terminal of the third switch tube and a second connection terminal coupled to the scan output terminal. In this way, the level of the first connection terminal of the third switch tube can be raised in the scanning phase by the action of the fourth switch tube so that the control terminal level of the third switch tube is smaller than the first connection terminal level, avoid the third switch tube threshold drift error affect the output of the scan terminal.

DETAILED DESCRIPTION OF PREFERRED EMBODIMENTS

Figure 1:
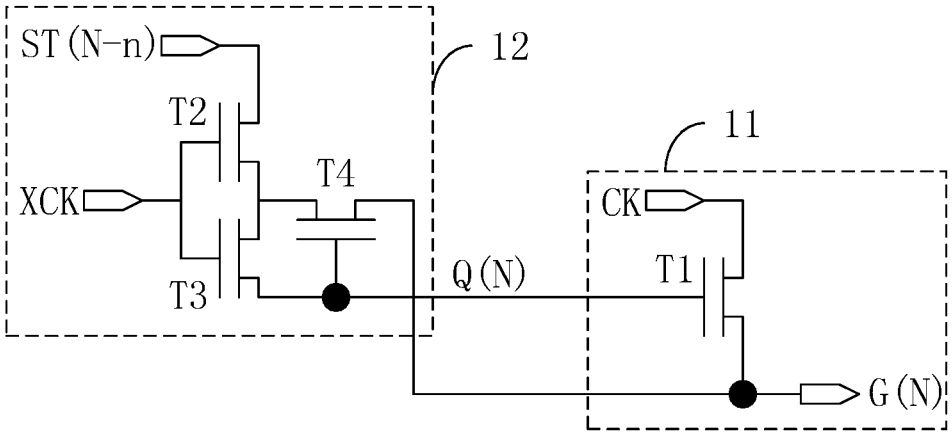
FIG. 1 is a schematic structural view of the first embodiment of the GOA circuit of the present disclosure.

Refer to FIG. 1, FIG. 1 is a schematic structural view of the first embodiment of the GOA circuit of the present disclosure, the GOA circuit includes:

a pull-up circuit 11 including a first switch tube T1.

A scan output terminal G(N) coupled to the second connection terminal of the first switch tube T1. Wherein, the first connection terminal of the first switch tube T1 is configured to receive the first clock signal CK, when the control terminal of the first switch tube is at the high level, the first switch tube T1 is turned on and the first clock signal CK is outputted through the scan output terminal G (N).

A pull-up control circuit 12 includes:

a second switch tube T2.

A third switch tube T3 having a first connection terminal coupled to the second connection terminal of the second switch tube T2, a second connection terminal coupled to the control terminal of the first switch tube T1.

A fourth switch tube T4 having a control terminal coupled to the control terminal of the first switch tube T1, a first connection terminal coupled to the first connection terminal of the third switch tube T3, a second connection terminal coupled to the scan output terminal G(N) for controlling the control terminal level of the second switch tube T2 to be lower than the first connection terminal level of the second switch tube T1 when the first level is outputted at the scan output terminal.

Wherein, the first connection terminal of the second switch tube T2 is configured to receive the level-transmission signal ST(N−n) outputted by the GOA circuit on the upper stage (or upper n stage), the control terminal of the second switch tube T2 and third switch tube T3 are configured to receive the second clock signal XCK.

It is understood that the XCK is high level during the scanning preparation stage of the GOA circuit of the stage (i.e., the previous stage of the scanning phase), the stage signal ST (N−n) outputted from the GOA circuit of the upper stage is high level, and the CK is low level.

Specifically, at the high level of XCK, T2 and T3 turn on and the high level ST (N−n) charge the Q (N) to raise the level of Q (N). In Q (N) under the action of high, the T1 is turned on, but this time the CK is low, so the G (N) output low.

In the scanning phase, the XCK is low, the CK is high.

Specifically, at the XCK low level, T2 and T3 are turned off, the Q (N) continue to maintain high. In the Q (N) under the action of high, the T1 continues to turn on, this time CK is high, so G (N) output high.

It should be noted that at this stage, T4 turns on and the high level of G (N) goes to the first connection terminal of T3 under the effect of Q (N) high, so that the first connection terminal of T3 level T3 higher than the control side, to prevent the T3 at this stage threshold drift and conduction.

Different from the prior art, the GOA circuit of the present disclosure includes: a pull-up circuit including a first switch tube; a scan output terminal coupled to the second connection terminal of the first switch tube; a pull-up control circuit including: a second switch tube; a third switch tube having a first connection terminal coupled to the second connection terminal of the second switch tube and a second connection terminal coupled to the control terminal of the first switch tube; a fourth switch tube having a control terminal coupled to the control terminal of the first switch tube, a first connection terminal coupled to the first connection terminal of the third switch tube and a second connection terminal coupled to the scan output terminal. In this way, the level of the first connection terminal of the third switch tube can be raised in the scanning phase by the action of the fourth switch tube so that the control terminal level of the third switch tube is smaller than the first connection terminal level, avoid the third switch tube threshold drift error affect the output of the scan terminal.

Figure 2:
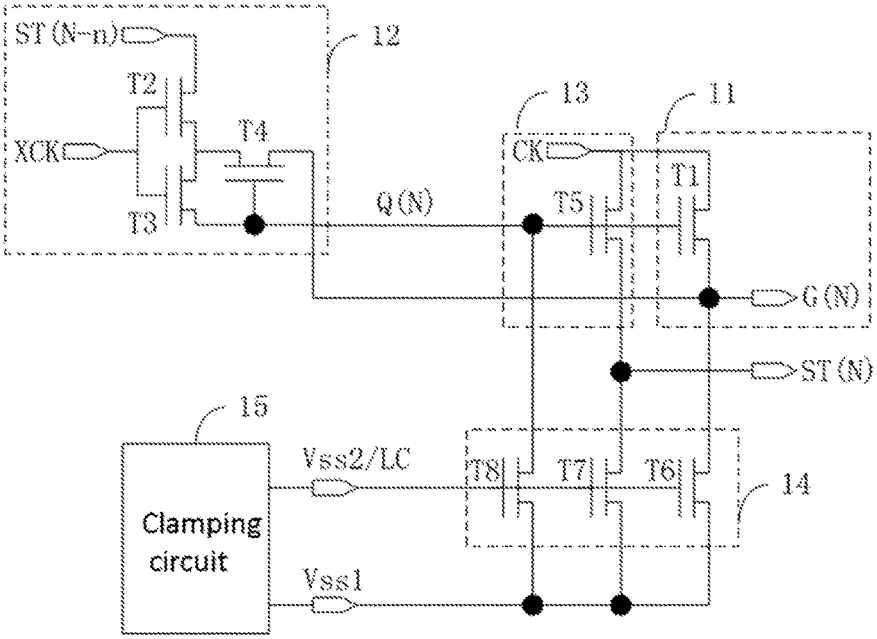
FIG. 2 is a schematic structural view of the second embodiment of the GOA circuit of the present disclosure.

Refer to FIG. 2, FIG. 2 is a schematic structural view of the second embodiment of the GOA circuit of the present disclosure, the GOA circuit includes a pull-up circuit 11, a pull-up control circuit 12, a intermediate circuit 13, a first pull-down circuit 14, a clamping circuit 15, a scan output terminal G(N) and a level-transmission output terminal ST(N).

Wherein, the pull-up circuit 11 and the pull-up control circuit 12 are connected in the same manner as in the above-described first embodiment, and will not be described here.

The intermediate circuit 13 includes a fifth switch tube T5 having a control terminal coupled to the second connection terminal of the third switch tube T3 and a second connection terminal coupled to the level-transmission output terminal ST(N).

Wherein, the level-transmission output terminal ST(N) is similar to the scan output terminal G(N), which also outputs the CK signal when T5 is turned on, but the outputted signal is used to input the next stage or lower n-stage GOA circuit pull-up control circuit.

Wherein, the first pull-down circuit 14 includes:

a sixth switch tube T6 having a first connection terminal coupled to the scan output terminal G(N).

A seventh switch tube T7 having a first connection terminal coupled to the level-transmission output terminal ST(N);

a eighth switch tube T8 having a first connection terminal coupled to the second output terminal of the third switch tube T3.

A clamping circuit 15 coupled to the control terminal and second connection terminal of the sixth switch tube T6, the seventh switch tube T7 and the eighth switch tube T8 for controlling the control terminal level of the sixth switch tube T6, the seventh switch tube T7 and the eighth switch tube T8 to be lower than the second connection terminal level of the sixth switch tube T6, the seventh switch tube T7 and the eighth switch tube T8, when the first level is outputted at the scan output terminal G(N) and for controlling the control terminal level of the sixth switch tube T6, the seventh switch tube T7 and the eighth switch tube T8 to be higher than the second connection terminal level of the sixth switch tube T6, the seventh switch tube T7 and the eighth switch tube T8, when the second level is outputted at the scan output terminal, the first level being higher than the second level.

It is understood that, in the G (N) output high, T1, T5 open, Q (N) is high; At this time, should ensure that T6, T7, T8 completely cut-off, in order to prevent the conduction threshold drift of T6, T7, T8, the clamping circuit 15 supplies Vss2 to the control terminals of T6, T7 and T8, and Vss1 to the second terminals of T6, T7 and T8, where Vss1>Vss2, and T6, T7 and T8 are completely turned off.

When G (N) outputs a low level, T6, T7, and T8 are turned on, and the level of G (N) is pulled low by the low level Vss1. Accordingly, the clamp circuit 15 supplies the control terminal of T6, T7, T8 a high level, supplies the Vss1 to the second connection terminal of T6, T7, T8, ensure the T6, T7, T8 are turned on.

Figure 3:
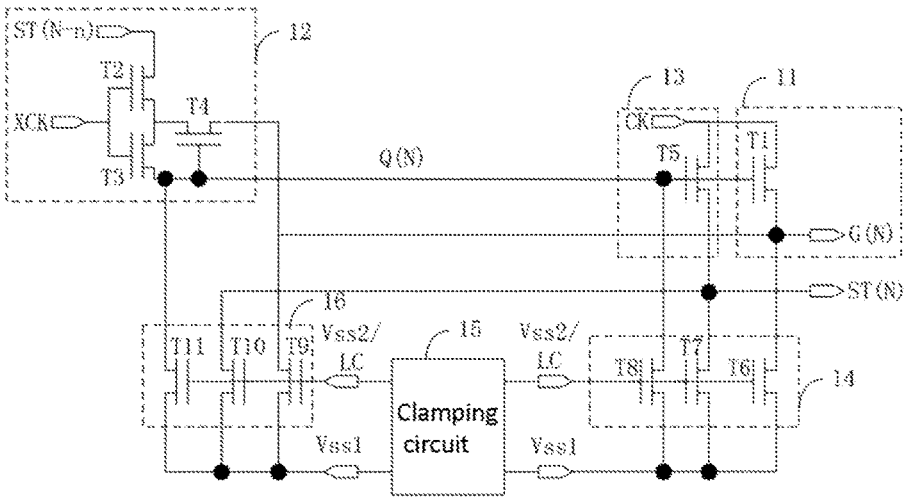
FIG. 3 is a schematic structural view of the third embodiment of the GOA circuit of the present disclosure.

Refer to FIG. 3, FIG. 3 is a schematic structural view of the third embodiment of the GOA circuit of the present disclosure, the GOA circuit includes a pull-up circuit 11, a pull-up control circuit 12, a intermediate circuit 13, a first pull-down circuit 14, a clamping circuit 15, a second pull-down circuit 16, a scan output terminal G(N) and a level-transmission output terminal ST(N).

Wherein, the pull-up circuit 11, the pull-up control circuit 12, the intermediate circuit 13, the first pull-down circuit 14, the clamping circuit 15 are connected in the same manner as in the above-described second embodiment, and will not be described here.

Wherein, the second pull-down circuit 16 includes:

a ninth switch tube T9 having a first connection terminal coupled to the second connection terminal of the third switch tube T3.

A tenth switch tube T10 having a first connection terminal coupled to the level-transmission output terminal ST(N).

A eleventh switch tube T11 having a first connection terminal coupled to the scan output terminal G(N).

the clamping circuit 15 coupled to the control terminal and second connection terminal of the ninth switch tube T9, the tenth switch tube T10, the eleventh switch tube T11 for controlling the control terminal level of the ninth switch tube T9, the tenth switch tube T10, the eleventh switch tube T11 to be lower than the second connection terminal level of the ninth switch tube T9, the tenth switch tube T10, the eleventh switch tube T11, when the scan output terminal outputted the first level, and for controlling the control terminal level of the ninth switch tube T9, the tenth switch tube T10, the eleventh switch tube T11 to be higher than the second connection terminal level of the ninth switch tube T9, the tenth switch tube T10, the eleventh switch tube T11, when the scan output terminal outputted the second level.

It will be understood that the second pull-down circuit 16 of the present embodiment is the same as the first pull-down circuit 14 and will not be described again.

Alternatively, in the present embodiment, the clamping circuit 15 controls the first pull-down circuit 14 and the second pull-down circuit 16 to operate alternately.

Figure 4:
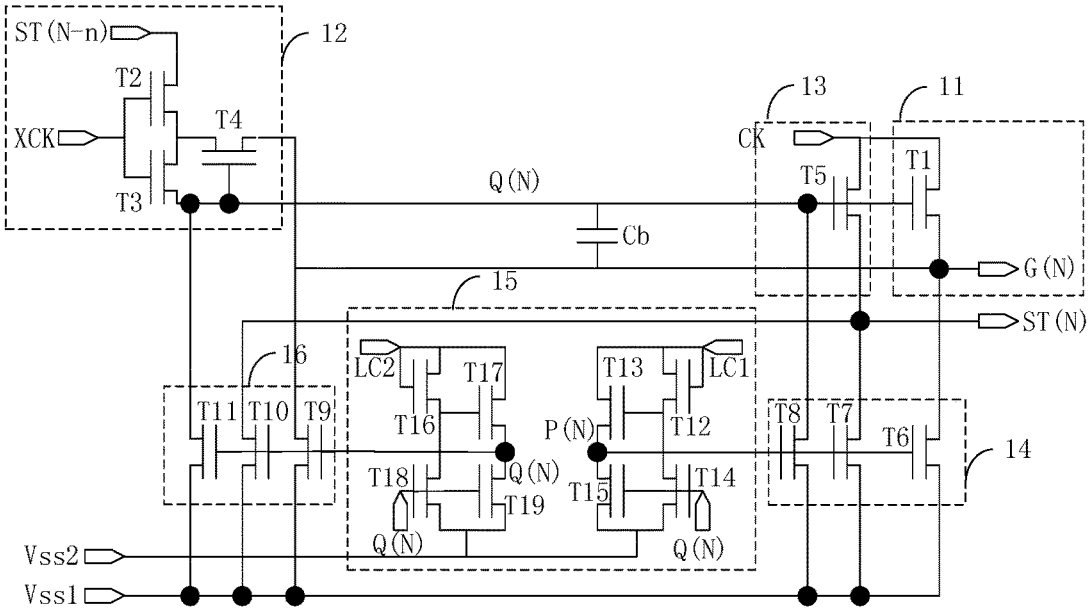
FIG. 4 is a schematic circuit diagram of the fourth embodiment of the GOA circuit of the present disclosure.

Refer to FIG. 4, FIG. 4 is a schematic circuit diagram of the fourth embodiment of the GOA circuit of the present disclosure, the GOA circuit includes a pull-up circuit 11, a pull-up control circuit 12, a intermediate circuit 13, a first pull-down circuit 14, a clamping circuit 15, a second pull-down circuit 16, a scan output terminal G(N) and a level-transmission output terminal ST(N).

Wherein, the pull-up circuit 11, the pull-up control circuit 12, the intermediate circuit 13, the first pull-down circuit 14, and the second pull-down circuit 16 are the same as in the above-described embodiment, and will not be described here.

Wherein, the clamping circuit 15 includes a first control circuit, a second control circuit, a first clamp terminal, a second clamp terminal.

The first clamp terminal is configured to receive the third level Vss1, coupled to the second connection terminal of the sixth switch tube T6, the seventh switch tube 67 and the eighth switch tube 68, the second clamp terminal is configured to receive the fourth level Vss2, the third level Vss1 is higher than the fourth level Vss2.

The first control circuit includes:

a twelfth switch tube T12 having a control terminal and a first connection terminal configured to receive a first control signal LC1.

A thirteenth switch tube T13 having a control terminal coupled to the second connection terminal of the twelfth switch tube T12, a first connection terminal configured to receive the first control signal LC1, a second connection terminal coupled to the control terminal of the sixth switch tube T6, the seventh switch tube T7 and the eighth switch tube T8.

A fourteenth switch tube T14 having a control terminal coupled to the second connection terminal of the third switch tube T3, a first connection terminal coupled to the second connection terminal of the twelfth switch tube T12, a second connection terminal coupled to the second clamp terminal.

A fifteenth switch tube T15 having a control terminal coupled to the second connection terminal of the third switch tube T3, a first connection terminal coupled to the second connection terminal of the thirteenth switch tube T13, a second connection terminal coupled to the second clamp terminal.

Wherein, the control terminal level of the sixth switch tube T6, the seventh switch tube T7, and the eighth switch tube T8 is defined as P (N).

The second control circuit includes:

a sixteenth switch tube T16 having a control terminal and a first connection terminal configured to receive the second control signal LC2.

A seventeenth switch tube having a control terminal coupled to the second connection terminal of the sixteenth switch tube, a first connection terminal configured to receive a second control signal LC2, a second connection tube coupled to the control terminal of the ninth switch tube T9, the tenth switch tube T10 and the eleventh switch tube T11.

A eighteenth switch tube T18 having a control terminal coupled to the second connection terminal of the third switch tube T3, a first connection terminal coupled to the second connection terminal of the sixteenth switch tube T16, a second connection terminal coupled to the second clamp terminal.

A nineteenth switch tube T19 having a control terminal coupled to the second connection terminal of the third switch tube T3, a first connection terminal coupled to the second connection terminal of the seventeenth switch tube T17, a second connection terminal coupled to the second clamp terminal.

Wherein, the control terminal level of the ninth switch tube T9, the tenth switch tube T10, and the eleventh switch tube T11 is defined as K (N).

Optionally, the pull-up circuit 11 further includes a capacitor Cb coupled between the scan output terminal G (N) and the control terminal of the first switch tube T1.

Alternatively, the present embodiment will be described below with reference to a specific embodiment:

In the present embodiment, the first connection terminal of the first switch tube T1 is configured to receive the first clock signal CK, the control terminal of the second switch tube T2 and the third switch tube T3 are configured to receive the second clock signal XCK, the first connection terminal of the second switch tube T2 is configured to receive the level-transmission signal ST(N−4); the first clock signal CK is opposite to the second clock signal XCK.

Figure 5:
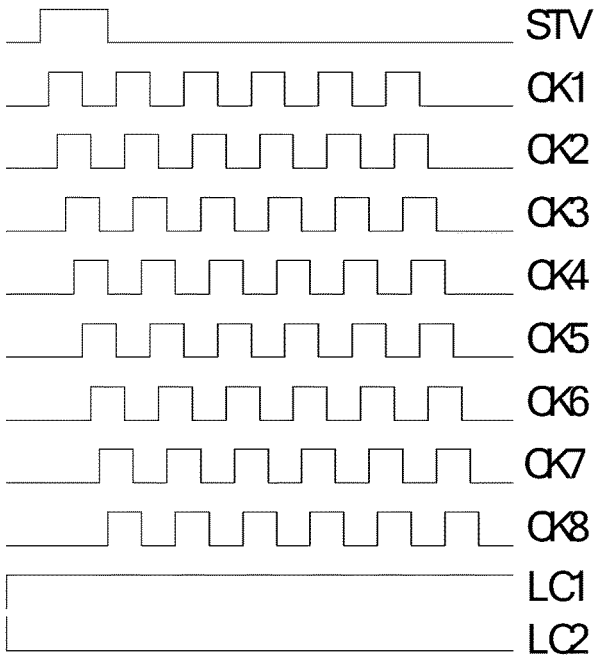
FIG. 5 is a schematic diagram of the clock signal of the fourth embodiment of the GOA circuit of the present disclosure.

In particular, as shown in FIG. 5. The present embodiment uses eight clock signals CK, that is, the CK signal of the Nth GOA circuit is the same as the CK signal of the (N+8) th GOA circuit and opposite to the CK signal of the (N+4) th GOA circuit. LC1, LC2 is the opposite of a set of low-frequency AC power supply, 100 frame reversal time. Vss1, Vss2 are two DC power supplies, Vss1>Vss2.

Figure 6:
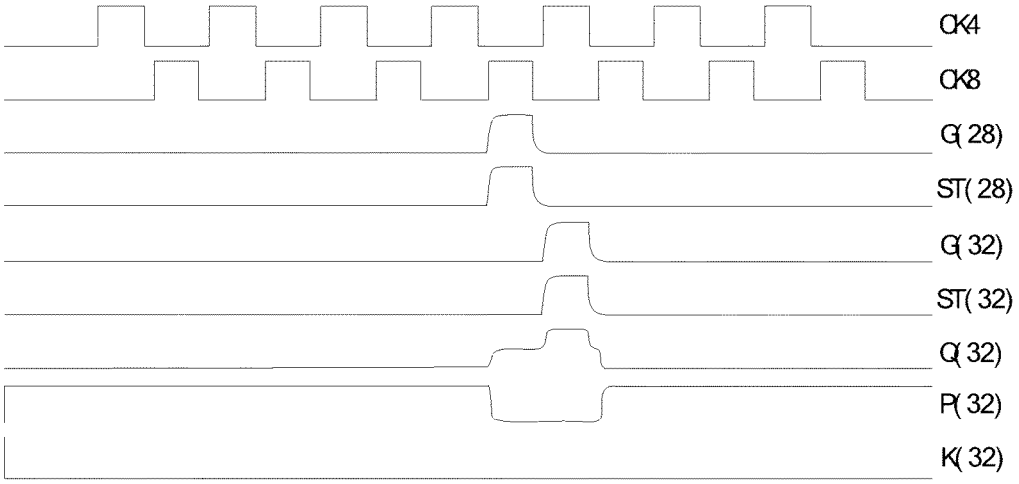
FIG. 6 is a schematic diagram of the output signal of the fourth embodiment of the GOA circuit of the present disclosure.

With the above-mentioned waveform into the circuit, the following in conjunction with FIG. 6, with the 32th GOA (G32) as an example to illustrate the circuit operation.

Assume that LC1 is high level H and LC2 is low level L in this frame.

When G (N)=G (32), ST (N−4)=ST (28), G (32) is controlled by CK8, ST (28) is controlled by CK4 and XCK is CK4.

When ST (28) is high, CK4 is high level, T2, T3 open, the high level of ST (28) to Q (32), Q is high level. At the same time, T1, T5 open, this time, CK8 is low, so G (32), ST (32) is low; at the same time, since Q is high, T14, T15, T18, T19 open, Vss2 makes P (32), K (32) are low, T6, T7, T8, T9, T10, T11 are off, at this time, the control terminal of T6, T7, T8, T9, T10, T11 is Vss2, the second connection end is Vss1, Vss1 is greater than Vss2, therefore, T6, T7, T8, T9, T10, T11 will not turn on erroneously due to the conduction threshold drift and will not affect the level of G (N).

Then, ST (28) is low, CK4 is low, T2, T3 closed, this time, CK8 is high, G (32) output high, Q (32) by the coupling effect of capacitance Cb, is raised to a higher level; P (32), K (32) continue to remain low.

Then, CK4 is high, the low level of ST(28) is to Q(32), the Q(32) is pulled low; at the same time, K(32) is low level, P(32) is high level, T6, T7, T8 are opened, Q(32), G(32), ST(32) are pulled low.

It will be appreciated, by those skilled in the art that the first and second connection terminals of the above-described switch tube do not represent the order of the pin of the switch tube but rather the specific designation of the pin of the switch pin. The switch tube mentioned in each of the above embodiments is a TFT (Thin Film Transistor) fabricated by IGZO, alternatively, the TFT in the above-described embodiment is N-type, the control terminal is a gate, the first connection terminal is a source and the second connection terminal is a drain; or the control terminal is a gate, the first connection terminal is a drain and the second connection terminal is a source.

In other embodiments, a P-type TFT may be used for connection of the circuits, and it is only necessary to adjust the control terminal level or the order of the source and drain electrodes in accordance with the above-described embodiment.

Figure 7:
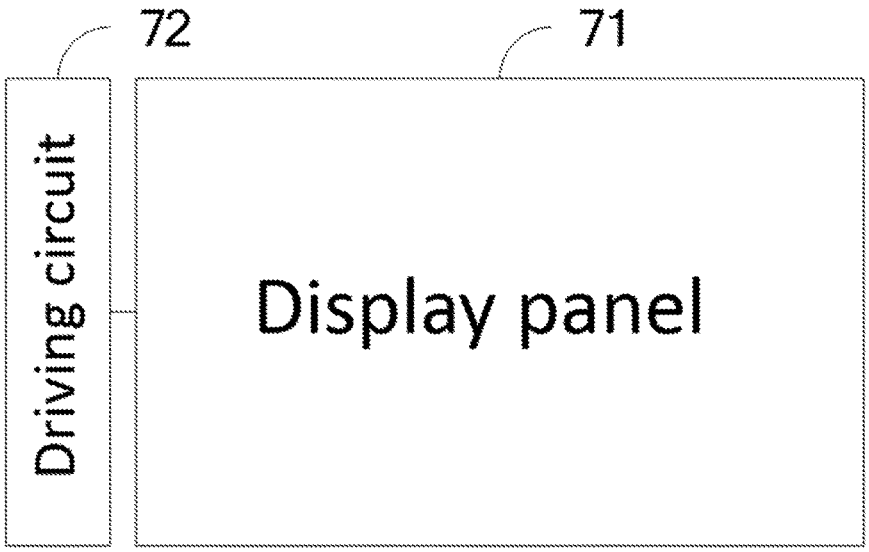
FIG. 7 is a schematic structural view of an embodiment of the liquid crystal display of the present disclosure.

Refer to FIG. 7, FIG. 7 is a schematic structural view of an embodiment of the liquid crystal display of the present disclosure, the liquid crystal display includes the display panel 71 and the driving circuit 72, wherein, the driving circuit 72 is arranged at the side of the display panel 71, is used to drive the display panel 71.

Specifically, the driving circuit 72 is a GOA circuit as described in each of the above embodiments, and operates similarly to the circuit configuration, and will not be described again.

The above are only embodiments of the present disclosure is not patented and therefore limit the scope of the present disclosure, the use of any content of the present specification and drawings made equivalent or equivalent structural transformation process, either directly or indirectly in other relevant technical fields are included in the same way the scope of patent protection of the present disclosure.

What is claimed is:

1. A liquid crystal display comprises a GOA (Gate Driver on Array) circuit, wherein, the GOA circuit comprises:

a pull-up circuit comprising a first switch tube;

a scan output terminal coupled to a second connection terminal of the first switch tube;

the pull-up circuit further comprises a capacitor coupled between the scan output terminal and a control terminal of the first switch tube;

a pull-up control circuit comprising:

a second switch tube;

a third switch tube having a first connection terminal coupled to a second connection terminal of the second switch tube and a second connection terminal coupled to the control terminal of the first switch tube;

a fourth switch tube having a control terminal coupled to the control terminal of the first switch tube, a first connection terminal coupled to the first connection terminal of the third switch tube and a second connection terminal coupled to the scan output terminal for controlling a control terminal level of the second switch tube to be lower than a first connection terminal level of the second switch tube when a first level is outputted at the scan output terminal;

wherein, the first connection terminal of the first switch tube is configured to receive a first clock signal, the control terminal of the second switch tube and the third switch tube is configured to receive a second clock signal, the first connection terminal of the second switch tube is configured to receive a level-transmission signal, and the first clock signal is opposite to the second clock signal.

2. The liquid crystal display according to claim 1, wherein, the GOA circuit further comprises:

a intermediate circuit comprising a fifth switch tube whose control terminal is coupled to the second connection terminal of the third switch tube and whose second connection terminal is coupled to the level-transmission output terminal.

3. The liquid crystal display according to claim 2, wherein, the GOA circuit further comprises a pull-down circuit and a clamp circuit;

The first pull-down circuit comprises:

a sixth switch tube having a first connection terminal coupled to the scan output terminal;

a seventh switch tube having a first connection terminal coupled to the level-transmission output terminal;

a eighth switch tube having a first connection terminal coupled to the second connection terminal of the third switch tube;

the clamp circuit is coupled to the control terminal and second connection terminal of the sixth switch tube, the seventh switch tube and the eighth switch tube for controlling the control terminal level of the sixth switch tube, the seventh switch tube and the eighth switch tube to be lower than the second connection terminal level of the sixth switch tube, the seventh switch tube and the eighth switch tube, when the first level is outputted at the scan output terminal and for controlling the control terminal level of the sixth switch tube, the seventh switch tube and the eighth switch tube to be higher than the second connection terminal level of the sixth switch tube, the seventh switch tube and the eighth switch tube, when the second level is outputted at the scan output terminal, the first level being higher than the second level.

4. The liquid crystal display according to claim 3, wherein, the GOA circuit further comprises a second pull-down circuit;

the second pull-down circuit comprises:

a ninth switch tube having the first connection terminal coupled to the second connection terminal of the third switch tube;

a tenth switch tube having the first connection terminal coupled to the level-transmission output terminal;

a eleventh switch tube having the first connection terminal coupled to the scan output terminal;

the clamp circuit coupled to the control terminal and second connection terminal of the ninth switch tube, the tenth switch tube, the eleventh switch tube for controlling the control terminal level of the ninth switch tube, the tenth switch tube, the eleventh switch tube to be lower than the second connection terminal level of the ninth switch tube, the tenth switch tube, the eleventh switch tube, when the scan output terminal outputted the first level, and for controlling the control terminal level of the ninth switch tube, the tenth switch tube, the eleventh switch tube to be higher than the second connection terminal level of the ninth switch tube, the tenth switch tube, the eleventh switch tube, when the scan output terminal outputted the second level.

5. The liquid crystal display according to claim 4, wherein, the clamp circuit comprises a first control circuit, a first clamp terminal and a second clamp terminal;

the first clamp terminal is configured to receive a third level and is coupled to the second connection terminal of the sixth switch tube, the seventh switch tube and the eighth switch tube, the second clamp terminal is configured to receive a fourth level, the third level is higher than the fourth level;

the first control circuit comprises:

a twelfth switch tube having a control terminal and a first connection terminal configured to receive a first control signal;

a thirteen switch tube having a control terminal coupled to the second connection terminal of the twelfth switch tube, a first connection terminal configured to receive the first control signal, a second connection terminal coupled to the control terminal of the sixth switch tube, the seventh switch tube and the eighth switch tube;

a fourteenth switch tube having a control terminal coupled to the second connection terminal of the third switch tube, a first connection terminal coupled to the second connection terminal of the twelfth switch tube, a second connection terminal coupled to the second clamp terminal;

a fifteenth switch tube having a control terminal coupled to the second connection terminal of the third switch tube, a first connection terminal coupled to the second connection terminal of the thirteenth switch tube, a second connection terminal coupled to the second clamp terminal.

6. The liquid crystal display according to claim 5, wherein, the clamp circuit further comprises a second control circuit;

the second control circuit comprises:

a sixteenth switch tube having a control terminal and a first connection terminal configured to receive a second control signal;

a seventeenth switch tube having a control terminal coupled to the second connection terminal of the sixteenth switch tube, a first connection terminal configured to receive the second control signal, a second connection terminal coupled to the control terminal of the ninth switch tube, the tenth switch tube and the eleventh switch tube;

a eighteenth switch tube having a control terminal coupled to the second connection terminal of the third switch tube, a first connection terminal coupled to the second connection terminal of the sixteenth switch tube, a second connection terminal coupled to the second clamp terminal;

a nineteenth switch tube having a control terminal coupled to the second connection terminal of the third switch tube, a first connection terminal coupled to the second connection terminal of the seventeenth switch tube, a second connection terminal coupled to the second clamp terminal.

7. A GOA (Gate Driver on Array) circuit, wherein, the GOA circuit comprises:

a pull-up circuit comprising a first switch tube;

a scan output terminal coupled to a second connection terminal of the first switch tube;

a pull-up control circuit comprising:

a second switch tube;

a third switch tube having a first connection terminal coupled to a second connection terminal of the second switch tube and a second connection terminal coupled to a control terminal of the first switch tube;

a fourth switch tube having a control terminal coupled to the control terminal of the first switch tube, a first connection terminal coupled to the first connection terminal of the third switch tube and a second connection terminal coupled to the scan output terminal for controlling a control terminal level of the second switch tube to be lower than the first connection terminal level of the second switch tube when a first level is outputted at the scan output terminal.

8. The GOA circuit according to claim 7, wherein, the GOA circuit further comprises:

a intermediate circuit comprising a fifth switch tube whose control terminal is coupled to the second connection terminal of the third switch tube and whose second connection terminal is coupled to the level-transmission output terminal.

9. The GOA circuit according to claim 8, wherein, the GOA circuit further comprises a pull-down circuit and a clamp circuit;

the first pull-down circuit comprises:

a sixth switch tube having a first connection terminal coupled to the scan output terminal;

a seventh switch tube having a first connection terminal coupled to the level-transmission output terminal;

a eighth switch tube having a first connection terminal coupled to the second connection terminal of the third switch tube;

the clamp circuit is coupled to the control terminal and second connection terminal of the sixth switch tube, the seventh switch tube and the eighth switch tube for controlling the control terminal level of the sixth switch tube, the seventh switch tube and the eighth switch tube to be lower than the second connection terminal level of the sixth switch tube, the seventh switch tube and the eighth switch tube, when the first level is outputted at the scan output terminal and for controlling the control terminal level of the sixth switch tube, the seventh switch tube and the eighth switch tube to be higher than the second connection terminal level of the sixth switch tube, the seventh switch tube and the eighth switch tube, when the second level is outputted at the scan output terminal, the first level being higher than the second level.

10. The GOA circuit according to claim 9, wherein, the GOA circuit further comprises a second pull-down circuit;

the second pull-down circuit comprises:

a ninth switch tube having the first connection terminal coupled to the second connection terminal of the third switch tube;

a tenth switch tube having the first connection terminal coupled to the level-transmission output terminal;

a eleventh switch tube having the first connection terminal coupled to the scan output terminal;

the clamp circuit coupled to the control terminal and second connection terminal of the ninth switch tube, the tenth switch tube, the eleventh switch tube for controlling the control terminal level of the ninth switch tube, the tenth switch tube, the eleventh switch tube to be lower than the second connection terminal level of the ninth switch tube, the tenth switch tube, the eleventh switch tube, when the scan output terminal outputted the first level, and for controlling the control terminal level of the ninth switch tube, the tenth switch tube, the eleventh switch tube to be higher than the second connection terminal level of the ninth switch tube, the tenth switch tube, the eleventh switch tube, when the scan output terminal outputted the second level.

11. The GOA circuit according to claim 10, wherein, the clamp circuit comprises a first control circuit, a first clamp terminal and a second clamp terminal;

the first clamp terminal is configured to receive a third level and is coupled to the second connection terminal of the sixth switch tube, the seventh switch tube and the eighth switch tube, the second clamp terminal is configured to receive a fourth level, the third level is higher than the fourth level;

the first control circuit comprises:

a twelfth switch tube having a control terminal and a first connection terminal configured to receive a first control signal;

a thirteen switch tube having a control terminal coupled to the second connection terminal of the twelfth switch tube, a first connection terminal configured to receive the first control signal, a second connection terminal coupled to the control terminal of the sixth switch tube, the seventh switch tube and the eighth switch tube;

a fourteenth switch tube having a control terminal coupled to the second connection terminal of the third switch tube, a first connection terminal coupled to the second connection terminal of the twelfth switch tube, a second connection terminal coupled to the second clamp terminal;

a fifteenth switch tube having a control terminal coupled to the second connection terminal of the third switch tube, a first connection terminal coupled to the second connection terminal of the thirteenth switch tube, a second connection terminal coupled to the second clamp terminal.

12. The GOA circuit according to claim 11, wherein, the clamp circuit further comprises a second control circuit;

the second control circuit comprises:

a sixteenth switch tube having a control terminal and a first connection terminal configured to receive a second control signal;

a seventeenth switch tube having a control terminal coupled to the second connection terminal of the sixteenth switch tube, a first connection terminal configured to receive the second control signal, a second connection terminal coupled to the control terminal of the ninth switch tube, the tenth switch tube and the eleventh switch tube;

a eighteenth switch tube having a control terminal coupled to the second connection terminal of the third switch tube, a first connection terminal coupled to the second connection terminal of the sixteenth switch tube, a second connection terminal coupled to the second clamp terminal;

a nineteenth switch tube having a control terminal coupled to the second connection terminal of the third switch tube, a first connection terminal coupled to the second connection terminal of the seventeenth switch tube, a second connection terminal coupled to the second clamp terminal.

13. The GOA circuit according to claim 7, wherein, the pull-up circuit further comprises a capacitor coupled between the scan output terminal and the control terminal of the first switch tube.

14. The GOA circuit according to claim 7, wherein, the first connection terminal of the first switch tube is configured to receive a first clock signal, the control terminal of the second switch tube and the third switch tube is configured to receive a second clock signal, the first connection terminal of the second switch tube is configured to receive a level-transmission signal; and the first clock signal is opposite to the second clock signal.

* * * * *